United States Patent [19]

Matsuda et al.

[11] Patent Number: 4,746,455

[45] Date of Patent: May 24, 1988

[54] LIQUID DETERGENT COMPOSITION FOR CLOTHING ARTICLES

[75] Inventors: Koichi Matsuda, Utsunomiya; Atsuo Nakae, Saitama; Moriyasu Murata; Akira Suzuki, both of Utsunomiya, all of Japan

[73] Assignee: KAO Corporation, Tokyo, Japan

[21] Appl. No.: 64,706

[22] Filed: Jun. 22, 1987

[30] Foreign Application Priority Data

| | | | |
|---|---|---|---|
| Jun. 27, 1986 | [JP] | Japan | 61-151139 |
| Oct. 1, 1986 | [JP] | Japan | 61-234176 |
| Oct. 31, 1986 | [JP] | Japan | 61-259922 |
| Apr. 16, 1987 | [JP] | Japan | 62-94040 |
| Apr. 17, 1987 | [JP] | Japan | 62-94962 |

[51] Int. Cl.[4] ..... C11D 3/37

[52] U.S. Cl. ..... 252/174.23; 252/174.18; 252/174.21; 252/174.24; 252/530; 252/540; 252/549; 252/559; 252/DIG. 2; 252/DIG. 14

[58] Field of Search ..... 252/174.23, 174.24, 252/DIG. 2, DIG. 14, 174.21, 174.18, 530, 540, 549, 559, 173

[56] References Cited

U.S. PATENT DOCUMENTS

| | | | |
|---|---|---|---|
| 3,326,807 | 6/1967 | Guest et al. | 252/174.23 |
| 3,790,488 | 2/1974 | Iino | 252/174.23 |
| 3,819,525 | 6/1974 | Hattenbrun | 252/174.23 |
| 3,956,163 | 5/1976 | Lee | 252/DIG. 14 |
| 4,670,060 | 6/1987 | Su et al. | 252/174.23 |
| 4,673,526 | 6/1987 | Zabotto et al. | 252/174.23 |
| 4,702,858 | 10/1987 | Denzinger et al. | 252/DIG. 2 |

*Primary Examiner*—A. Lionel Clingman
*Assistant Examiner*—Hoa Van Le
*Attorney, Agent, or Firm*—Oblon, Fisher, Spivak, McClelland & Maier

[57] ABSTRACT

A novel liquid detergent composition for clothing articles comprising from 0.01 to 10 wt % of an organic polymer, which has a specific particle size, in the form of a polymer latex.

The detergent composition has a good shrink resistance for felt.

4 Claims, No Drawings

LIQUID DETERGENT COMPOSITION FOR CLOTHING ARTICLES

BACKGROUND OF THE INVENTION (1) Field of the Invention

This invention relates to detergent compositions and more particularly, to liquid detergent compositions for clothing articles which exhibit a good shrink resistance for felts.

(2) Description of the Prior Art

For the wash of clothes and particularly, wool articles at home, it was usual to adopt a so-called wash-by-hand method in which water or tepid water was charged into a vessel such as a washbowl, a detergent was then dissolved in the water, and clothes were immersed in the detergent solution. However, this method requires much time and labor since the clothes are washed by rubbing or pressing directly with hands. Because hands are immersed over a long time in washing water having a relatively high concentration, the hands are disadvantageously apt to be chapped. Accordingly, attempts have been made to wash these clothes by the use of an electric washing machine. However, the washing of clothes, such as wool articles, with a washing machine presents the problem of felt shrinkage that the clothes are shrunken owing to the strong mechanical force.

SUMMARY OF THE INVENTION

The present inventors made intensive studies to prevent the felt shrinkage and, as a result, found that the felt shrinkage could be prevented when a polymer latex having a specific particle size was added to a liquid detergent composition. The present invention was accomplished on the basis of the above finding.

According to the invention, there is provided a liquid detergent composition for clothing articles comprising the following ingredient (A):

(A) from 0.01 to 10 wt % of an organic polymer in the form of a polymer latex, said organic polymer having an average particle size (average in weight) of from 0.005 to 0.2 micrometers with a content of a polymer having a size of from 0.005 to 0.2 micrometers being not less than 95 wt % of the total of the polymer latex.

DETAILED DESCRIPTION OF THE INVENTION AND PREFERRED EMBODIMENTS

The particle size of the polymer of the polymer latex (A) used in the present invention is as defined above. If the particle size is larger, the adherence to fibers lowers, so that the resistance to shrinkage of felts is not recognized. In this sense, latices which have been hitherto formulated in detergents as a opacifier have an average particle size not smaller than 0.2 micrometers and a wide size distribution. Accordingly, these known latices do not show the effects of the invention.

The polymer latex (A) comprising an organic polymer with the above-defined particle size cannot be prepared by known emulsion polymerization processes in which droplets of a polymerizable monomer are polymerized in coexistence with a polymerization system.

The polymer latex of the invention is prepared by polymerizing a water-insoluble, polymerizable monomer in a state of a microemulsion or in a solubilized state. The microemulsion state or condition is realized by using a nonionic surface active agent while selecting an appropriate temperature near a phase inversion temperature, or using an anionic surface active agent in combination with an auxiliary surface active agent such as a higher alcohol, a nonionic surface active agent or the like. The solubilized state can be achieved by adding a large amount of surface active agents relative to a polymerizable monomer.

Preferably, there is used a method in which a nonionic surface active agent is used and a monomer is polymerized at a temperature in the vicinity of a phase inversion temperature under such a microemulsion state that the interfacial tension between the monomer and water is not larger than 1 dyne/cm, preferably not larger than 0.5 dyne/cm.

The preparation of polymer latices used as the ingredient (A) of the invention is described along with polymerizable monomers.

(1) Addition polymer latex

Addition polymer latices are obtained by polymerizing a polymerizable monomer in a condition where a microemulsion state is kept in such a way that the polymerizable monomer is solubilized in micelles formed by a surface active agent and an aqueous solution of the surface active agent used has an interfacial tension between the monomer and water of less than 1 dyne/cm.

Examples of the polymerizable monomers may be any known monomers used for emulsion polymerization and include ethylenically unsaturated monomers such as ethylene, propylene, isobutene, butene-1 and the like; aromatic vinyl monomers such as styrene, alphamethylstyrene, vinyltoluene, halogenated styrene, divinylbenzene and the like; acrylic esters whose alkyl group has from 1 to 20 carbon atoms, such as ethyl acrylate, butyl acrylate, 2-ethylhexyl acrylate and the like; methacrylic esters having from 1 to 20 carbon atoms, such as methyl methacrylate, butyl methacrylate, lauryl methacrylate and the like; vinyl esters such as vinyl acetate, vinyl propionate and the like; vinyl ethers having from 1 to 20 carbon atoms, such as ethyl vinyl ether, butyl vinyl ether and the like; vinyl ketones having from 1 to 20 carbon atoms, such as methyl vinyl ketone, ethyl vinyl ketone and the like; vinyl cyan monomers such as acrylonitrile, methacrylonitrile and the like; vinyl halides and vinylidene halides such as vinyl chloride, vinyl bromide, vinylidene chloride, vinylidene bromide and the like; and aliphatic conjugated dienes such as 1,3-butadiene, 2-methyl-1,3-butadiene and the like.

Moreover, nitrogen-containing monomers may also be used as the polymerizable monomer. Examples of such monomers are ethylenically unsaturated nitrogen-containing monomers having a cationic group or a tertiary amino group and represented by the following general formulae (I) and (II)

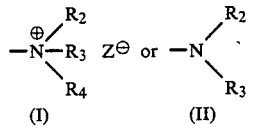

(I) (II)

in which $R_2$, $R_3$ and $R_4$ represent an alkyl or substituted alkyl group having from 1 to 18 carbon atoms or a hydrogen atom and may be the same or different, or two of the three groups may join to complete, along with an adjacent nitrogen atom, a heterocyclic ring such as a pyridyl group or an imidazoyl group, a cycloalkyl group or a heterocycloalkyl group, and Z represents a halogen atom or an acid residue. Examples of the ethylenically unsaturated nitrogen-containing monomers include: monovinylpyridines such as vinylpyridine, 2-methyl-5-vinylpyridine, 2-ethyl-5-vinylpyridine and the like; dialkylamino group-containing styrenes such as N,N-dimethylaminostyrene, N,N-dimethylaminomethylstyrene and the like; acrylic or methacrylic esters having a dialkylamino group such as N,N-dimethylaminoethyl methacrylate, N,N-dimethylaminoethyl acrylate, N,N-diethylaminoethyl methacrylate, N,N-diethylaminoethyl acrylate, N,N-dimethylaminopropyl methacrylate, N,N-dimethylaminopropyl acrylate, N,N-diethylaminopropyl methacrylate, N,N-diethylaminopropyl acrylate and the like; vinyl ethers having a dialkylamino group such as 2-dimethylaminoethyl vinyl ether; and acrylamides or methacrylamides having a dialkylamino group such as N-(N',N'-dimethylaminoethyl)methacrylamide, N-(N',N'-dimethylaminoethyl)acrylamide, N-(N',N'-diethylaminoethyl)methacrylamide, N-(N',N'-diethylaminoethyl)acrylamide, N-(N',N'-dimethylaminopropyl)methacrylamide, N-(N',N'-dimethylaminopropyl)acrylamide, N-(N',N'-diethylaminopropyl)methacrylamide, N-(N',N'-diethylaminopropyl)acrylamide and the like.

The monomers mentioned above may be used singly or in combination. In addition, these monomers may be copolymerized with maleic anhydride, a water-soluble monomer, styrenesulfonic acid or styrenesulfonates, vinylnaphthalenesulfonic acid or vinylnaphthalenesulfonates, or acrylic acid or acrylates.

The most preferable method of preparing the addition polymer latex is a method in which a surface active agent is added to a reactor into which water has been charged, to prepare an aqueous solution, and agitated under heating conditions in the vicinity of a temperature at which the micelles of the surface active agent are subjected to phase transition so that the interfacial tension between a monomer and water is kept within a range not larger than 1 dyne/cm, preferably from 1 to 0.5 dyne/cm. Under these conditions, a polymerizable monomer and, if necessary, an aqueous solution of a radical polymerization initiator are added in order to start the polymerization. Thereafter, the polymerizable monomer is gradually added in such a way that the interfacial tension between the aqueous solution of the surface active agent and the monomer phase is kept outside of the above range, thereby carrying out the polymerization.

The radical polymerization initiators include, for example, persulfates such as potassium persulfate, sodium persulfate, ammonium persulfate and the like, azo compounds such as 2,2'-azobis(2-amidinopropane) mineral acid salts, azobiscyanovaleric acid and its alkali metal salts and an ammonium salts, and Redox initiators such as tartaric acid-hydrogen peroxide, Rongalite-peroxides, ascorbic acid-peroxides and the like. When cationic surface active agents are used in the polymerization system, 2,2'-azobis(2-amidinopropane) mineral acid salts are preferably used. In other polymerization systems, persulfates are preferably used. The amount of the radical polymerization initiator is generally in the range of from 0.1 to 5 parts by weight, preferably from 0.1 to 3 parts by weight, per 100 parts by weight of a monomer.

The reaction temperature should be a maximum temperature within a solubilizing region in the vicinity of the phase inversion temperature and is preferably in the range of from 50° to 90° C. The time required for the polymerization may depend on the types composition and concentration of monomers, the concentration of the radical polymerization initiator and the polymerization temperature, and is preferably from 5 to 50 hours.

In this manner, a polymer latex containing polymers having an average particle size of from 0.005 to 0.2 micrometers and containing not less than 95 wt % of particles having a size within in the above range, is obtained.

(2) Polycondensation polymer latices

Polycondensation polymer latices are obtained by polymerizing a polycondensating monomer in such a microemulsion state that the monomer is solubilized in micelles formed by a surface active agent and an aqueous solution of the surface active agent used has an interfacial tension between the water and the surface active agent of not larger than 1 dyne/cm.

Examples of the polycondensating monomers may be any known monomers which are ordinarily used for interfacial polycondensation or low temperature polycondensation. Preferably, monomers capable of yielding polyamides and polyesters are used. The acid ingredients used to prepare polyamides are, for example, acid chlorides or acid anhydrides of alkylenedicarboxylic acids whose hydrocarbon moiety has from 1 to 24 carbon atoms, dimeric acids, phthalic acids such as terephthalic acid, isophthalic acid and the like, aromatic monovalent carboxylic acids, alicyclic polyvalent carboxylic acids such as cyclohexyldicarboxylic acid, and the like. Additionally, thioesters of dicarboxylic acids may also be used. The diamines are, for example, aliphatic polyamines such as alkylenediamines or alkylenetriamines whose hydrocarbon moiety has from 1 to 24 carbon atoms, aromatic polyamides such as phenylene diamines, and polyvalent amines having a heterocyclic ring such as 4,4'-diaminophenyl ether.

The alcohol ingredients used to prepare polyesters include, for example, alkylene diols whose hydrocarbon moiety has from 1 to 24 carbon atoms, ethylene glycol condensates such as bis-betahydroxyethyl terephthalate, aromatic polyhydric alcohols such as hydroquinone, bisphenol A and the like, polyhydric alcohols such as glycerine derivatives, and the like. The acid ingredients may be those indicated above with respect to the polyamides.

The monomers may not be limited to those indicated above and may be used singly or in combination.

In order to carry out the polycondensation reaction, a surface active agent is charged into a reactor having water therein, in which an acid ingredient is solubilized while agitating, followed by adding an aqueous solution of a diamine or alcohol. Alternatively, the respective ingredients are separately dissolved in an organic solvent, and the resulting solutions are solubilized in the respective aqueous solutions of a surface active agent and mixed together. When a monomer used is solid, it is preferably dissolved in an organic solvent and solubilized in micelles along with the solvent and subjected to polycondensation. The solvent used should be insoluble in water and is conveniently benzene, toluene, xylene or the like. The reaction temperature is a temperature within a solubilizing region in the vicinity of a phase transition temperature and is preferably in the range of from −10° to 50° C. The reaction temperature may vary depending on the type, composition and concentration of monomer and the temperature, and is preferably in the range of from 2 to 60 minutes.

In this manner, there is obtained a polymer latex containing polymers having an average size of from 0.005 to 0.2 micrometers and containing not less than 95 wt % of polymer particles having a size within the above range.

(3) Polyaddition polymer latices

The polyaddition polymer latex is obtained by polymerizing monomers capable of polyaddition in such a microemulsion state that the monomer is solubilized in sheet micelles formed by a surface active agent and an aqueous solution of the surface active agent used has an interfacial tension between the monomer and water is not larger than 0.5 dyne/cm.

The polyaddition monomers may be any known monomers ordinarily used for the polyaddition reaction. In particular, monomers capable of producing polyurethanes, polyurea resins and epoxy resins are preferred.

The alcohol ingredients used for the preparation of polyurethanes are compounds having at least two hydroxyl groups in one molecule and include, for example, ethylene glycol, propylene glycol, butylene glycol, hexadiol, neopentyl glycol, polyethylene glycol, polypropylene glycol, polyoxytetramethylene glycol, glycerine, trimethylolpropane, polyesters having two or more hydroxyl groups at ends thereof and the like. The isocyanate ingredients are those compounds having at least two isocyanate groups in one molecule and are, for example, tolylene diisocyanate, xylylene diisocyanate, hexamethylene diisocyanate, 4,4'-diphenylmethane diisocyanate, triphenylmethane triisocyanate, trimethylolpropane triisocyanate, and polyesters, polyethers and polyurethanes having two or more isocyanate groups at ends thereof.

The isocyanate ingredients used to prepare polyurea resins may be those compounds indicated with respect to the polyurethanes. The amine ingredients are those compounds having at least two amino groups in one molecule and include, for example, hexamethylenediamine, dodecyldiamine, phenylenediamine, diaminodiphenyl ether, piperazine and the like.

The epoxy ingredients used to prepare epoxy resins are compounds having at least two epoxy groups in one molecule and include, for example, diglycidyl ether of bisphenol A, glycidyl esters of dimeric acids, compounds obtained by oxidizing olefins, and the like. The amine ingredients may be those amine compounds indicated with respect to the polyurea. Curing agents may be any known compounds for this purpose including, aside from tertiary amines, boron trifluoride-amine complexes and imidazole, amines, polyamines, carboxylic anhydrides, polysulfides, dicyandiamides, diisocyanates and the like having functional groups capable of polyaddition reaction with epoxy groups.

The polyaddition reaction is carried out as follows. In order to obtain polyurethane and polyurea resins, a surface active agent is charged into a reactor having water therein, into which an isocyanate ingredient is solubilized under agitation. Thereafter, an aqueous diol or diamine solution is added to the reaction system. Alternatively, both ingredients may be separately dissolved in an organic solvent and the resulting solutions are, respectively, solubilized in aqueous solutions of a surface active agent and combined together. For the preparation of epoxy resins, a solution of a prepolymer or an epoxy-terminated compound and various curing agents in a solvent is gradually dropped into an aqueous solution of a surface active agent.

If the monomer used is solid or a viscous liquid, it is preferred to effect the polyaddition reaction in which the monomer is dissolved in an organic solvent and solubilized in micelles along with the solvent. The organic solvent should be an inert solvent which is not soluble in water and does not react with other ingredients. Benzene, toluene, xylene and the like are preferred. The reaction temperature is within a solubilizing region in the vicinity of a phase transition temperature and is generally in the range of from 20° to 70° C. The reaction time may vary depending upon the type, composition and concentration of monomer and is generally in the range of from 1 to 50 hours.

It will be noted that although phenolic resins are polycondensates and may be prepared similar to the above-described epoxy resins. For the preparation of phenolic resins, phenol or phenol derivatives such as cresol and formaldehyde may be used. Alternatively, resol resins and novolac resins may be used and cured by means of polyamines.

The thus obtained latex contains polymers having an average particle size of from 0.005 to 0.2 micrometers and particles having a size within the above range are contained in amounts of not less than 95 wt % of the total particles.

The average particle size of the polymer in the latex used in the present invention is, as defined above, in the range of from 0.005 to 0.2 micrometers, preferably from 0.01 to 0.1 micrometer, on the weight basis. Not less than 95 wt % of the polymer latex particles should have a size within a range of from 0.005 to 0.2 micrometers.

In view of the flexibility, the polymers in the latices should preferably have a glass transition temperature (Tg) not higher than 300° K.

Polymers whose glass transition temperature is not higher than 300° K. are, for example, polyaddition polymer latices including polyacrylic esters such as polyethyl acrylate, polybutyl acrylate and the like, polymethacrylic esters such as poly-2-ethylhexyl methacrylate, polylauryl methacrylate and the like, and polyvinyl ethers such as polybutoxyethylene, polymethoxyethylene and the like; polyesters such as polyoxytrimethyleneoxadipropyl, polyoxytetramethyleneoxycarbonyl-1,4-cyclohexylenecarbonyl and the like; and polyurethanes such as polyoxy-2-butenyleneoxycarbonylimonohexamethyleneiminocarbonyl, polyoxy-2,2-diethyltrimethyleneoxycarbonylimino-4-methyl-1,3-phenyleneiminocarbonyl and the like.

Of these latices, preferable ones are addition polymer latices, among which polymers or copolymers of $\alpha,\beta$-unsaturated carboxylic acid ester monomers such as acrylates and methacrylates, which have a glass transition temperature (Tg) of not higher than 300° K., are most preferred.

Other preferable latices are polymer latices having a cationic group or a tertiary amino group (which may be hereinafter referred to simply as "nitrogen-containing latices"). These are obtained by polymerizing ethylenically unsaturated nitrogen-containing monomers alone or along with water-insoluble polymerizable monomers. However, other processes described below may also be used for the preparation of such latices.

(1) Polymers obtained by polymerizing water-insoluble ethylenically unsaturated monomers and ethylenically unsaturated nitrogen-containing monomers are quaternarized with known quaternarizing agents including, for example, alkyl halides in which the alkyl group has from 1 to 18 carbon atoms, and the halogen is chlorine, bromine or iodine, benzyl halides such as benzyl chloride, benzyl bromide and the like, alkyl esters of alkyl or arylsulfonic acids in which the alkyl group has from 1 to 18 carbon atoms, e.g. methanesulfonic acid, benzenesulfonic acid, and toluenesulfonic acid, and dialkyl sulfates whose alkyl group has from 1 to 4 carbon atoms.

(2) Either copolymers of ethylenically unsaturated monomers having a halogenated methyl group ($-CH_2X$), e.g. chloromethylstyrene, 3-chloro-1-propene, 3-bromo-1-propene, 2-chloroethyl acrylate, 2-chloroethyl methacrylate, 2-bromoethyl acrylate, 2-bromoethyl methacrylate, 3-chloropropyl acrylate, 3-chloropropyl methacrylate, 3-bromopropyl acrylate, 3-bromopropyl methacrylate, 4-chloropropyl acrylate, 4-chloropropyl methacrylate, 2-chloroethyl vinyl ether and the like, and water-insoluble ethylenically unsaturated monomers, or chloromethylated polymers of polystyrene or copolymers of styrene and other water-insoluble ethylenically unsaturated monomers are reacted with aliphatic tertiary amines such as trimethylamine, triethylamine, tripropylamine, tributylamine, triamylamine, n-octyldimethylamine, n-dodecyldimethylamine and n-tetradecyldimethylamine, or aromatic amines such as dimethylaniline, diethylaniline, tribenzylamine and the like.

(3) Polymers obtained by copolymerizing ethylenically unsaturated monomers having an epoxy group such as glycidyl (meth)acrylate, vinyl phenylglycidyl ether, vinyl phenylethylene oxide, allyl glycidyl ether and the like, with water-insoluble ethylenically unsaturated monomers are reacted with secondary amines to cause the epoxy group to be opened and, at the same time, are introduced with a tertiary amino group. Subsequently, the resultant polymers are quaternarized according to the method described in (1).

(4) Polymers having a hydroxyl group such as saponified products of either copolymers of ethylenically unsaturated monomers having a hydroxyl group, e.g. 2-hydroxyethyl acrylate, 2-hydroxyethyl methacrylate, 2-hydroxypropyl acrylate, 2-hydroxypropyl methacrylate, N-2-hydroxyethyl acrylamide and the like, and water-insoluble, ethylenically unsaturated monomers, or copolymers of water-insoluble, ethylenically unsaturated monomers and fatty acid esters of vinyl alcohol are reacted with cationized with glycidyltrimethylammonium hydrochloride or a 3-chloro-2-hydroxypropyltrimethylammonium salt.

(5) Ethylenically unsaturated monomers having a cationic group, which are obtained by quaternarizing ethylenically unsaturated monomers having a tertiary amino group with quaternarizing agents described in (1) or by reacting ethylenically unsaturated monomers having a chloromethyl group as indicated in (2) with aliphatic or aromatic amines indicated in (2), are copolymerized with water-insoluble ethylenically unsaturated monomers.

In (2) to (5), it is not necessarily required to form quaternarized products or salts, but tertiary salts of the general formula (II) may be used. The tertiary amino group exhibits a weakly cationic property in an aqueous solution (neutral to acidic solution).

The liquid detergent for clothing articles according to the invention may be obtained by directly adding the thus obtained polymer latex to a base for the liquid detergent for clothing articles, or by adding a suspension of the latex concentrated to a desired level to the base. The polymer latex is generally added to the liquid detergent in an amount of from 0.01 to 10 wt % (hereinafter referred to simply as %), preferably from 0.05 to 5%, when calculated as a residue left after removal of the water.

Because the above-described nitrogen-containing polymer latex usually contains a remaining monomer in an amount of from 200 to 300 ppm, it is preferred to remove the monomer prior to formulation in the liquid detergent composition of the invention. The removal of the remaining monomer may be effected by ordinary distillation under reduced pressure, steam distillation under reduced pressure, thin film separation under reduced pressure, bubbling by blowing air, adsorption using an adsorbent, and the like. The amount of the remaining monomer should preferably be below 100 ppm, more preferably below 40 ppm and most preferably below 10 ppm.

The liquid detergent composition of the invention may comprise, aside from the polymer latex, one or more of the following surface active agents (ingredient (B)).

Anionic surface active agents are used as the surface active agent, including linear or branched alkylbenzenesulfonates, alkyl or alkenyl ether sulfates, alkyl or alkenyl sulfates, olefinsulfonates, alkanesulfonates, alpha-sulfo fatty acid salts or esters, saturated or unsaturated fatty acid salts, alkyl or alkenyl ether carbonates, amino acid-type surface active agents, N-acylaminoacid-type surface active agents, alkyl or alkenyl phosphoric acid esters or salts thereof, and the like.

Examples of amphoteric surface active agents include carboxy or sulfo betaine-type surface active agents. Examples of nonionic surface active agents include polyoxyalkylene alkyl or alkenyl ethers, polyoxyethylene alkylphenyl ethers, higher fatty acid alkanolamides or alkylene oxide adducts thereof, sucrose-fatty acid esters, fatty acid esters, fatty acid-glycerine monoesters, alkylamido oxides and the like. Examples of cationic surface active agents include quaternary ammonium salts.

These surface active agents are generally used in an amount of 10 to 50% of the liquid detergent composition.

Preferable formulation examples of the liquid detergent composition for clothing articles of the invention are described below.

Formulation Example 1

Liquid detergent composition comprising the following ingredients (A)′, (B-1) and (B-2):

(A)′ Polymer latex containing polymers having a cationic group or a tertiary amino group and having an average particle size (on the weight basis) of from 0.005 to 0.2 micrometers with 95 wt % or more of the particles having a size of from 0.005 to 0.2 micrometers: 0.01 to 5 wt % as polymer (B-1) Nonionic surface active agent: 10 to 50 wt %

(B-2) Anionic surface active agent: 0.01 to 10 wt %

The nonionic surface active agent used as ingredient (B-1) in this formulation example may be any agents ordinarily used in detergents, of which those indicated in (1) and (2) below are preferred.

(1) Polyoxyethylene alkyl or alkenyl ethers whose alkyl or alkenyl group has from 10 to 20 carbon atoms on average and in which 1 to 20 moles of ethylene oxide are added.

(2) Polyoxyethylene alkylphenyl ethers whose alkyl group has from 6 to 12 carbon atoms on average and in which 1 to 20 moles of ethylene oxide are added.

The nonionic surface active agent, ingredient (B-1), is preferably used in an amount of from 10 to 50 wt % (hereinafter referred to simply as %) of the composition.

Preferable anionic surface active agents used as ingredient (B-2) are those indicated in (1) to (7) below.

(1) Linear or branched alkylbenzenesulfonates whose alkyl group has from 10 to 16 carbon atoms on average.

(2) Alkyl or alkenylethoxysulfonates which has a linear or branched alkyl or alkenyl group having from 10 to 20 carbon atoms on average and in which 0.5 to 8 moles of ethylene oxide on average are added in the molecule.

(3) Alkyl or alkenylsulfonates which have an alkyl or alkenyl group having from 10 to 20 carbon atoms on average.

(4) Olefinsulfonates having from 10 to 20 carbon atoms on average in one molecule.

(5) Alkanesulfonates having from 10 to 20 carbon atoms on average in one molecule.

(6) Fatty acid salts having from 8 to 20 carbon atoms.

(7) Salts or esters of alpha-sulfofatty acids of the following formula $$R_1CH(SO_3Y)CO_2X$$

in which X represents an alkyl group having from 1 to 3 carbon atoms or a counter ion of the above described anionic surface active agent, Y represents a counter ion of the above described anionic surface active agent, and $R_1$ represents an alkyl or alkenyl group having from 10 to 20 carbon atoms.

The (C) ingredient is added to the composition of the invention in an amount of from 0.01 to 10%, preferably from 0.1 to 5%.

The liquid detergent composition of this formulation is obtained by directly adding a compound having a cationic group or a tertiary amino group or (A)′ ingredient as selected from the (A) ingredients, to a liquid detergent base containing the (B-1) and (B-2) ingredients, or adding a suspension of the compound concentrate to a desired level, to the base. The (A)′ ingredient is added to the liquid detergent composition in an amount of from 0.001 to 5%, preferably from 0.1 to 3%, as a residue obtained after removal of the water by distillation.

The detergent composition prepared in this formulation example can solve not only the felt shrinkage problem, but also a problem of recontamination in which soils coming off from clothes are again deposited on fiber surfaces.

Formulation Example 2

A liquid detergent composition for clothing articles comprising the following ingredients (A)′, (B-1)′ and (B-1)″:

(A)′ Polymer latex containing polymers having a cationic group or a tertiary amino group and having an average particle size (on the weight basis) of from 0.005 to 0.2 micrometers with 95 wt % or more of particles having a size of from 0.005 to 0.2 micrometers: 0.01 to 5 wt % as polymer (B-1)′ Polyoxyalkylene nonionic surface active agent having an HLB value not smaller than 20:0.01 to 5 wt %

(B-1)″ Nonionic surface active agent other than (B-1)′: 10 to 50 wt %

The polyoxyalkylene nonionic surface active agents having an HLB value not smaller than 20, which are the (B-1)′ ingredient of this composition, include, for example, those agents selected from the following compounds but having an HLB value not smaller than 20: polyoxyethylene alkyl ethers, polyoxyethylene alkylphenyl ethers, polyethylene glycol-fatty acid esters, polyoxyethylene sorbitan-fatty acid esters, polyoxyethylene glycerine-fatty acid esters, polyoxyethylene sorbit-fatty acid esters, polyoxyethylenepolyoxypropylene alkyl ethers, polyoxyethylene castor oil, hardened castor oil and the like. Of these, polyoxyethylene alkyl ethers and polyethylene glycol-fatty acid esters having an HLB value not smaller than 20 are preferred.

The term "HLB value" used herein means a value determined according to the following equation:

$$HLB = \Sigma(\text{number of hydrophilic groups}) - \Sigma(\text{number of oleophilic groups}) + 7$$

The numbers of typical HLB groups in the above equation are shown below.

| Hydrophilic Group | | Oleophilic Group | |
|---|---|---|---|
| Ester (sorbitan ring) | 6.8 | $-CH_2-$ | |
| Ester (free) | 2.4 | $CH_3-$ | −0.475 |
| −OH (free) | 1.9 | $=CH-$ | |
| | | derived groups | |
| −O− | 1.3 | $-(CH_2CH_2O)-$ | +0.33 |
| −OH (sorbitan ring) | 0.5 | $-(CH_2CH_2CH_2O)-$ | −0.15 |
| | | $-(CH_2CH(CH_3)-CHO)-$ | −0.15 |

The content of the (B-1)′ ingredient in the above composition is generally in the range of from 0.01 to 5%, preferably from 0.1 to 3 wt % of the total composition. With the content less than 0.01%, the effect is too small whereas over 5%, foaming is unfavorably impeded.

The nonionic surface active agent (B-1)″ other than (B-1)′, used as the main detergent base, may be any agents ordinarily used in detergents and has generally an HLB value of from 13 to 18. Preferably, the agents of (1) and (2) in the foregoing formulation example are used.

The nonionic surface active agent (B-1)″ other than (B-1)′ is used in an amount of from 10 to 50% of the composition.

The liquid detergent composition in this formulation example can solve not only the felt shrinkage problem, but also the slippery problem on hands and the problem of poor breakage of foams.

Formulation Example 3

A liquid detergent composition for clothing articles comprising the following ingredients (A), (B-1)‴ and (C):

(A) Polymer latex containing polymers having an average particle size (on the weight basis) of from 0.005 to 0.2 micrometers with 95 wt % or more of the particles having a size of 0.005 to 0.2 micrometers: 0.01 to 10 wt % as organic polymer (B-1)''' a nonionic surface active agent of the general formula $$R—O—(CH_2CH_2O)_n—H$$

in which R represents an alkyl or alkenyl group having from 10 to 20 carbon atoms, or an alkylphenyl group whose alkyl group has from 6 to 12 carbon atoms, and n is a value of from 1 to 20: 10 to 50 wt %

(C) a hydroxycarboxylate having from 2 to 6 carbon atoms: 0.005 to 0.25 wt %

The nonionic surface active agents used as the (B-1)''' ingredient of the invention are those of the above general formula. When the number of moles of added ethylene oxide, n, exceeds 20, the detergent lower in foaming strength and detergency. Preferably, the number of addition moles is in the range of from 6 to 16.

The (B-1)''' ingredient is formulated in the composition in an amount of from 10 to 50%, preferably from 10 to 40%.

The hydroxycarboxylates having from 2 to 6 carbon atoms, which are used as the (C) ingredient in this formulation example, include, for example, sodium, potassium and alkanolamine salts of glycollic acid, lactic acid, malic acid, tartaric acid, citric acid and the like. Of these, the lactate is the most preferable because it exhibits the best effect of preventing the lowering of pH and does not impede the stability of the system.

The amount of the (C) ingredient is in the range of from 0.005 to 0.25%. If the amount is less than 0.005%, the effect of preventing the pH lowering is not satisfactory. On the other hand, over 0.25%, the effect of imparting the flexibility is undesirably impeded.

Organic acid salts other than hydroxycarboxylic acid salts, e.g. salts of lower fatty acid monocarboxylic acids such as acetic acid, butyric acid and the like and salts of dicarboxylic acids such as oxalic acid, succinic acid and the like, and inorganic salts such as phosphates cannot impede the lowering of pH.

The detergents of this formulation example have the feature that any felt shrinkage does not occur and the detergents do not lower in pH when preserved over a long time even at high temperatures.

The composition of the invention may further comprise auxiliary additives including, for example, high molecular weight electrolytes such as polyacrylic acid, polyaconitic acid and the like, non-dissociating polymers such as polyvinyl alcohol, polyvinylpyrrolidone and the like, divalent metal ion-collecting agents, e.g. salts of organic acids such as diglycollic acid and oxycarboxylic acids and the like, inorganic electrolytes such as sulfates, re-contamination preventing agents such as polyethylene glycol, carboxymethyl cellulose and the like, enzymes such as protease, amylase, lipase, cellulase and the like, enzyme stabilizers such as calcium chloride, antioxidants such as tertiary butylhydroxytoluene, distyrenated cresol and the like, solubilizing agents, such as lower alcohols such as ethanol, lower alkylbenzenesulfonates such as benzenesulfonates, p-toluenesulfonates and the like, glycols such as propylene glycol, solubilizing agents such as acetylbenzenesulfonates, acetamides, pyridinecarboxylic acid amides, benzoates, urea and the like, fluorescent dyes, bluing agents, and flavors.

If the solubilizing agent is used in the detergent, it is preferred to use a polymer latex which has a content of a remaining monomer not higher than 100 ppm and in which the polymer used has a cationic group or a tertiary amino group. The amount of the solubilizing agent is preferably in the range of from 1 to 10%, more preferably from 3 to 7%, so as to ensure stable storage over a long term.

Although the felt shrinkage may take place in water only by application of a mechanical force, this is promoted in an aqueous surface active agent solution or a detergent solution. The reason why the polymer latex of the invention shows the effect of preventing the felt shrinkage is not known. Presumably, this is because the polymer latex is deposited on fiber surfaces and serves as a kind of cushion for preventing entangling of fibers.

Washing of wool articles in a washing machine by the use of the liquid detergent of the invention does not present any problem of felt shrinkage and thus, a good washing effect can be obtained.

The present invention is described in more detail by way of references and examples.

Reference 1

200 g of water, 16 g of polyoxyethylene(35) nonylpheneyl ether and 0.6 g of ammonium persulfate were charged into a separable flask having an agitator, which was sufficiently purged with nitrogen, followed by heating to 62° C. under agitation. 90.5 g of n-butyl acrylate was dropped in about 2 hours, followed by polymerization for further 6 hours to obtain latex A.

References 2 to 8

The general procedure of Reference 1 was repeated using monomers or monomer compositions indicated in Table 1 instead of n-butyl acrylate, thereby obtaining latices B to H. The physical properties of the latices obtained in references 1 to 8 are also shown in Table 1.

TABLE 1

| Latex | Monomer Composition (wt/wt) | Glass Transition Temperature Tg (°K.) | Weight Average Size (micrometers) | wt % of Particles Having a Size of 0.005 to 0.2 micrometers |
|---|---|---|---|---|
| A | n-Butyl acrylate | 215 | 0.03 | 100 |
| B | n-Butylacrylate/dimethylaminoethyl acrylate = 95/5 | 217 | 0.07 | 100 |
| C | n-Butyl acrylate/methacroyloxyethylene-trimethylammonium chloride = 99/1 | 214 | 0.05 | 100 |
| D | n-Butyl acrylate/diethylaminoethyl methacrylate = 95/5 | 219 | 0.04 | 100 |
| E | 2-Ethylhexyl methacrylate/diethylaminoethyl methacrylate = 95/5 | 264 | 0.07 | 98 |
| F | Dodecyl methacrylate/diethylaminoethyl methacrylate = 99/1 | 209 | 0.08 | 96 |

TABLE 1-continued

| Latex | Monomer Composition (wt/wt) | Glass Transition Temperature Tg (°K.) | Weight Average Size (micrometers) | wt % of Particles Having a Size of 0.005 to 0.2 micrometers |
|---|---|---|---|---|
| G | Methyl methacrylate | 378 | 0.40 | 30 |
| H | Styrene | 373 | 0.10 | 96 |

(Note)
The particle size was measured by a submicron particle analyzer "Coulter Model N-4" and indicated in terms of a weight average value.

Reference 9

(i) 343 g of water, 21 g of polyoxyethylene (35) nonylphenyl ether and a solution of 0.8 g of 2,2'-azobis(2-amidinopropane) hydrochloride in 8 g of water were charged into a separable flask equipped with an agitator, which was sufficiently purged with a nitrogen gas. Subsequently, while blowing a nitrogen gas under agitation, the system was heated to 62° C., into which 97 g of n-butyl acrylate and 3 g of N,N'-dimethylaminoethyl acrylate were dropped in about 2 hours, followed by polymerization for further 7 hours. After completion of the reaction, the system was cooled and filtered through a 200 mesh metal gauze to obtain latex I (n-butyl acrylate/dimethylaminoethyl acrylate =97/3). The latex I had a residual monomer content of 300 ppm.

(ii) The latex I obtained in (i) was subjected to steam distillation at 90° C. for 2, 4 and 6 hours to obtain purified latices I having residual monomer contents of 150 ppm, 40 ppm and 4 ppm, respectively.

References 10 to 14

The general procedure of Reference 9 was repeated using the monomer compositions and purifying conditions shown in Table 2 below, thereby obtaining purified latices J to N. The residual monomer contents of these purified latices are also shown in Table 2.

TABLE 2

| Purified Latex | Monomer Composition (weight ratio) | Steam Distillation Time (hours) | Residual Monomer Content (ppm) |
|---|---|---|---|
| J | n-butyl acrylate/DMAEA*(1) (99/1) | 6 | 3 |
| K | n-butyl acrylate/DMAEA*(1) (70/30) | 4 | 35 |
| L | Styrene/QDM*(2) (97/3) | 4 | 27 |
| M | n-Butyl acrylate/DEAEMA*(3) (95/5) | 5 | 10 |
| N | n-Butyl acrylate/QDM (70/30) | 4 | 22 |

*(1)dimethylaminoethyl acrylate
*(2)Methacryloyloxyethylenetrimethylammonium chloride
*(3)Diethylaminoethyl methacrylate Reference 15

(i) 200 g of water, 16 g of polyoxyethylene (35) nonylphenyl ether and 0.6 g of ammonium persulfate were charged into a separable flask equipped with an agitator, followed by purging sufficiently with nitrogen. Subsequently, while blowing a nitrogen gas under agitation, the system was heated to 62° C., into which a mixed solution of 95 g of 2-ethylhexyl methacrylate and 5 g of N,N'-diethylaminoethyl methacrylate was dropped in about 2 hours, followed by polymerization for further 6 hours. After completion of the reaction, the system was cooled and filtered through a 200 mesh metal gauze, thereby obtaining latex O (2-ethylhexyl methacrylate/diethylaminoethyl methacrylate=95/5 with a residual monomer content of 300 ppm).

(ii) The latex O obtained in (i) was subjected to steam distillation at 90° C. for 4 hours to obtain purified polymer latex O having a residual monomer content of 40 ppm (a weight average particle size of 0.07 micrometers, and 100% of the particles in a size range of from 0.005 to 0.2 micrometers).

Reference 16

Similar to the procedures (i) and (ii) of Reference 15, there were obtained latex P (n-butyl acrylate/dimethylaminoethyl acrylate =95/5, a residual monomer content of 35 ppm, a weight average particle size of 0.10 micrometer, and 96% of the particles having a size of from 0.005 to 0.2 micrometers) and latex Q (n-butyl acrylate/methacroyloxyethylenetrimethylammonium chloride =99/1, a residual monomer content of 30 ppm, a weight average particle size of 0.09 micrometer, and 100% of the particles having a size of from 0.005 to 0.2 micrometers).

EXAMPLE 1

The latices obtained in References 1 to 8 were used to prepare liquid detergent compositions for clothing articles having formulations indicated in Table 3. The liquid detergent compositions were checked with respect to a felt-shrinking ratio and flexibility. The results are shown in Table 4.

TABLE 3

| Composition | Detergent Component | Amount (%) | Latex | Amount (%) | Water |
|---|---|---|---|---|---|
| 1 | Polyoxyethylene ($\bar{p}$ = 10) alkyl ($C_{12}$–$C_{13}$) ether | 20 | A | 3 | balance |
| 2 | Polyoxyethylene ($\bar{p}$ = 10) alkyl ($C_{12}$–$C_{13}$) ether | " | B | 1 | " |
| 3 | Polyoxyethylene ($\bar{p}$ = 10) alkyl ($C_{12}$–$C_{13}$) ether | " | C | 0.5 | " |
| 4 | Polyoxyethylene ($\bar{p}$ = 10) alkyl ($C_{12}$–$C_{13}$) ether | " | D | 1 | " |
| 5 | Polyoxyethylene ($\bar{p}$ = 10) alkyl ($C_{12}$–$C_{13}$) ether | " | E | 1 | " |
| 6 | Polyoxyethylene ($\bar{p}$ = 10) alkyl ($C_{12}$–$C_{13}$) ether | " | F | 3 | " |
| 7 | Polyoxyethylene ($\bar{p}$ = 10) alkyl ($C_{12}$–$C_{13}$) ether | " | G | 3 | " |
| 8 | Polyoxyethylene ($\bar{p}$ = 10) alkyl ($C_{12}$–$C_{13}$) ether | " | H | 3 | " |
| 9 | Polyoxyethylene ($\bar{p}$ = 10) alkyl | " | — | — | " |

TABLE 3-continued

| Composition | Detergent Component | Amount (%) | Latex | Amount (%) | Water |
|---|---|---|---|---|---|
| | ($C_{12}$-$C_{13}$) ether | | | | |

(Test Method)

1. Measurement of a felt-shrinking ratio by washing:

(1) Preparation of a testing cloth

A non-processed piece of wool cloth having a size of 10×10 cm in which three side edges were cross-stitched with a lock-sewing machine was immersed in city water at normal temperatures for 30 minutes and dehydrated in a dehydrating vessel for 30 seconds, and was mounted on a gauze for drying and subjected to moisture conditioning in a chamber of 20° C. and 65% R.H. for 4 hours or longer. The cloth piece was marked and numbered at 4 portions with an oily felt pen. After conditioning at 20° C. and 65% R.H., the lengths were measured (lengths $a_1^0$, $a_2^0$, widths $b_1^0$, $b_2^0$) and were taken as original lengths (R.M).

(2) Washing method 3 pieces of testing cloth obtained in (i) were placed in one pot of a Terg-O-Tometer and washed by rotation at 120 r.p.m. for 10 minutes. The concentration of the respective detergents was set at 0.25% and the water temperature was 20° C. Rinsing was effected as follows: a first washing was carried out in the pot using running water and a second washing was effected in a hand-washing plastic tub using running water. Thereafter, the cloth pieces were attached to the walls of a dehydrator tub of the washing machine and dehydrated for 30 seconds, dried on a flat gauze, and conditioned at 20° C. and 65% R.H. for 4 hours or longer.

The lengths between the marks in (1) were again measured (lengths $a_1^w$, $a_2^w$, widths $b_1^w$, $b_2^w$), and a felt shrinking ratio and an area-shrinking ratio were, respectively, calculated using the lengths.

[Calculation of the shrinking ratio (according to IWS TM 9)]

$$\text{Felt shrinking ratio (\%)} = \frac{R.M. - W.M.}{R.M.} \times 100$$

in which R.M.: measured values (original lengths) prior to the washing and W.R.: measured values after the washing.

[Calculation of area shrinking ratio]

$$\text{Area shrinking ratio (\%)} = W.S. + L.S. - \frac{W.S. \times L.S.}{100}$$

in which W.S.: shrinking ratio along the width, and L.S.: shrinking ratio along the length.

2. Evaluation of softening 5 acrylic fiber jerseies having a size of 30 cm×60 cm or a wool sweater for deposition preventive test were washed by hands in 5 liters of a 0.25% detergent aqueous solution at a water temperature of 30° C. After drying in air, the acrylic fiber jerseies or wool sweater was subjected to a feeling test by five persons and ranked as follows.

o: More softly finished as compared with the case using a standard detergent.

Δ: Finished similar to the case using the standard detergent.

x: More rigidly finished than the case using the standard detergent.

(Results)

TABLE 4

| Detergent composition | Felt Area Shrinking Ratio (%) | Flexibility |
|---|---|---|
| Composition | | |
| 1 | 9.5 | o |
| 2 | 6.2 | o |
| 3 | 6.0 | o |
| 4 | 6.8 | o |
| 5 | 7.0 | o |
| 6 | 8.8 | o |
| 7 | 12.0 | Δ |
| 8 | 9.6 | Δ |
| Standard detergent 9 | 13.0 | —(standard) |
| City water alone (reference) | 9.4 | — |

As is shown in Table 3, the washing with the aqueous solution of the surface active agent facilitates the felt shrinkage to a greater extent than washing the city water alone. However, the addition of the latices A, B, C, D, E, F, and H can lower the shrinking level as city water. From the standpoint of the flexibility, it will be seen that latices of polystyrene having a high glass transition temperature arm not favorable.

EXAMPLE 2

Liquid detergent compositions for clothing articles having the formulations indicated in Table 5 were prepared and used to measure the felt area shrinking ratio similar to Example 1. The results are shown in Table 6.

TABLE 5

| Ingredients | Composition No. 10 | 11 | 12 | 13 |
|---|---|---|---|---|
| LAS* | 20 | 20 | — | — |
| Lauryl dimethylamine oxide | — | — | 20 | 20 |
| Latex B | 3 | — | 3 | — |
| Water | balance | balance | balance | balance |

*LAS: sodium linear alkyl (C = 12) benzenesulfonate (Results)

TABLE 6

| Composition No. | Felt Area Shrinkage Ratio (%) |
|---|---|
| 10 | 9.5 |
| 11 | 13.2 |
| 12 | 9.7 |
| 13 | 12.9 |
| Reference (city water alone) | 9.4 |

As will be apparent from the results of Table 6, an aqueous solution of the surface active agent alone has a higher shrinkage ratio than city water alone. However, when the polymer latex B is formulated, the shrinkage ratio lowers to substantially the same level as that of city water alone.

EXAMPLE 3

Liquid detergents shown in Table 8 were prepared and used to check the felt shrinking property and flexibility in the same manner as in Example 1. Moreover, the change in pH was also checked when these liquid detergents were stored. The results are shown in Table 8.

pH measurement:

According to the method prescribed in JIS Z 8802, the pH immediately after formulation at 25° C, and the pH values after storage for one month at 5°, 30° and 40° C. were measured by a glass electrode pH meter.

TABLE 8

| Composition (%) | 1 | 2 | 3 | 4 | 5 | 6 | 7 | 8 | 9 | 10 |
|---|---|---|---|---|---|---|---|---|---|---|
| Polyoxyethylene ($\bar{p}$ = 10) lauryl ether | 20 | 20 | 20 | 20 | 20 | 20 | 20 | 20 | 20 | 0 |
| Potassium lactate | 0.02 | 0.2 | 0 | 0 | 2 | 0.02 | 0.5 | 0 | 0 | 0 |
| Sodium glycollate | 0 | 0 | 0 | 0.2 | 0 | 0 | 0 | 0.02 | 0 | 0 |
| Sodium acetate | 0 | 0 | 0.02 | 0 | 0 | 0 | 0 | 0 | 0.02 | 0 |
| Latex | | | | | | | | | | |
| A | | | 3 | | | | | | | |
| B | 1 | | | | | | | 1 | | |
| C | | 0.5 | | | | | | | | |
| D | | | | 1 | | | | | | |
| E | | | | | 1 | | | | | |
| F | | | | | | 3 | | | | |
| H | | | | | | | 3 | | | |
| Ethanol | 5 | 5 | 5 | 5 | 5 | 5 | 5 | 5 | 5 | 5 |
| Water | balance | → | → | → | → | → | → | → | → | → |
| Felt shrinking ratio (area) (%) | 6.2 | 6.0 | 9.5 | 6.8 | 7.0 | 8.8 | 9.6 | 6.2 | 13.0 | 9.4 |
| pH | | | | | | | | | | |
| immediately after preparation | 7.5 | 8.0 | 7.5 | 8.0 | 7.5 | 7.5 | 8.0 | 7.5 | 8.0 | — |
| after one −5° C. | 7.5 | 8.0 | 7.0 | 8.0 | 7.5 | 7.5 | 8.0 | 7.5 | 7.0 | — |
| month 30° C. | 7.4 | 7.5 | 6.0 | 7.9 | 7.3 | 7.4 | 7.8 | 7.3 | 6.0 | — |
| storage 40° C. | 7.0 | 7.3 | 5.5 | 7.2 | 7.2 | 7.1 | 7.2 | 7.0 | 5.5 | — |
| Flexibility | o | o | o | o | Δ | o | Δ | o | reference | — |

As is shown in Table 8, the washing with the surface active agent aqueous solution promotes the felt shrinkage over city water alone. However, when latices A, B, C, D, E, F and H are added, the shrinkage lowers to a level for the city water. It will be apparent that from the standpoint of the flexibility, the latex of a polymer such as polystyrene having a high glass transition temperature is unfavorable. For the storage over a long time, the presence of the hydroxycarboxylate can prevent the lowering of pH.

EXAMPLE 4

The latex I and the purified latex I obtained in Reference 9 were used to prepare liquid detergent compositions in order to check the felt shrinking property and the storage stability. The results are shown in Table 9. The felt shrinking property (felt shrinking ratio) was determined in the same manner as in Example 1. The storage stability was determined in the following manner.

Storage stability:

A sample was placed in a screw tube (having a diameter of 4 cm and a height of 10 cm) and kept at 40° C, room temperature and −5° C. One month after the storage, coagulation, separation and precipitation were visually observed.

o: transparent liquid x: coagulated, separated or precipitated

TABLE 9

| Composition No. | 1 | 2 | 3* | 4* | 5 | 6 | 7 | 8 | 9* | 10 | 11 |
|---|---|---|---|---|---|---|---|---|---|---|---|
| Ingredient (B) | | | | | | | | | | | |
| Polyoxyethylene ($\bar{p}$ = 10) alkyl ($C_{12-13}$) ether | 20 | 20 | 20 | 20 | 20 | 40 | 20 | 20 | 20 | 20 | |
| Ingredient (A)" | | | | | | | | | | | |
| (residual monomer; ppm) | | | | | | | | | | | |
| Latex I (300) | 1 | | | | | | | | | | |
| Purified latex I (150) | | 1 | | | 1 | | | 1 | | | |
| Purified latex I (40) | | | 1 | | | 1 | 1 | | | | |
| Purified latex I (5) | | | | 1 | | | | | 1 | | |
| Ingredient (D) | | | | | | | | | | | |
| Ethanol | 5 | 5 | 5 | 5 | 20 | 0.5 | 15 | | | | |
| Sodium p-toluenesulfonate | | | | | | | | 3 | 3 | | |
| Water | balance | → | → | → | → | → | → | → | → | → | 100 |
| Felt shrinking ratio (area %) | 6.5 | 6.5 | 6.5 | 6.5 | 6.5 | 6.5 | 6.5 | 6.5 | 6.5 | 13.0 | 9.4 |
| Storage stability | | | | | | | | | | | |
| −5° C. | o | o | o | o | o | x | o | o | o | x | x |
| room temperature | o | o | o | o | x | x | x | o | o | o | o |
| 40° C. | x | x | o | o | x | o | x | x | o | o | o |

*Products of the invention

EXAMPLE 5

Liquid detergent compositions of the formulations indicated in Table 10 were prepared and used to check the felt shrinking property in the same manner as in Example 1 and the storage stability in the same manner as in Example 4. The results are shown in Table 10.

TABLE 10

| Composition No. | 12* | 13* | 14* | 15* | 16* | 17* | 18* | 19 | 20 |
|---|---|---|---|---|---|---|---|---|---|
| Ingredient (B) | | | | | | | | | |
| Polyoxyethylene ($\bar{p}$ = 10) alkyl ($C_{12-13}$)ether | 20 | 20 | 20 | 20 | | | 20 | | |
| Sodium linear alkyl ($C_{12-13}$) benzenesulfonate | | | | | 20 | | | 20 | |
| Lauryl dimethylamine oxide | | | | | | 20 | | | 20 |
| Ingredient (A)" | | | | | | | | | |
| Purified latex J | 1 | | | | | | | | |
| Purified latex K | | 1 | | | | | | | |
| Purified latex L | | | 0.5 | | | | | | |
| Purified latex M | | | | 3 | | | | | |
| Purified latex M | | | | | 3 | | | | |
| Purified latex M | | | | | | 3 | | | |
| Purified latex N | | | | | | | 1 | | |
| Ingredient (D) | | | | | | | | | |
| Ethanol | 5 | 5 | 5 | 5 | 2 | 5 | | | |
| Ethylene glycol | | | | | 3 | | 7 | | |
| Water | balance | → | → | → | → | → | → | → | → |
| Felt shrinking ratio (area) % | 6.4 | 6.3 | 6.0 | 6.2 | 9.5 | 8.0 | 6.3 | 13.2 | 12.9 |
| Storage Stability | | | | | | | | | |
| −5° C. | o | o | o | o | o | o | o | x | x |
| room temperature | o | o | o | o | o | o | o | o | o |
| 40° C. | o | o | o | o | o | o | o | o | o |

*Products of the invention

EXAMPLE 6

Liquid detergent of the formulations indicated in Table 11 were prepared and used to check the felt shrinking ratio in the same manner as in Example 1 and the effect of preventing re-contamination in the following manner. The results are shown in Table 11.

Judgement of the deposition preventive effect:

2.5 g of a detergent composition was dissolved in 1 liter of city water, to which 0.20 g of carbon black was added, followed by irradiation with ultrasonic waves for 10 minutes to uniformly disperse the carbon black. This testing bath was transferred to a washing bath of a Terg-O-Tometer, to which 6 pieces of clean non-processed wool cloth (10 cm × 10 cm) were added, followed by agitation at 20° C. for 10 minutes in the Terg-O-Tometer.

Thereafter, the test bath was discharged and 1 liter of clean city water of 20° C. was added, followed by agitation for further 3 minutes for rinsing. After the rinsing, the test cloth pieces were centrifugally dehydrated and dried in air.

The brightness of the dried cloth was classified into the following two group to determined the deposition preventive effect.

o: as white as the original test cloth x: darker than the original test cloth

TABLE 11

| | Detergent of Invention | | | Comparative Detergent | | |
|---|---|---|---|---|---|---|
| | 1 | 2 | 3 | 1 | 2 | 3 |
| Polyoxyethylene ($\bar{p}$ = 10) lauryl ether | 20% | 20 | 20 | 20 | 20 | 0 |
| Sodium dodecyl-benzenesulfonate | 3 | 0 | 0.1 | 0 | 0 | 0 |
| Sodium dodecyloxy-ethylene ($\bar{p}$ = 3) sulfate | 0 | 1 | 0 | 0 | 0 | 0 |
| Latex O*1 | 3 | 0 | 0 | 0 | 0 | 0 |
| Latex P*2 | 0 | 1 | 0 | 0 | 0 | 0 |
| Latex Q*3 | 0 | 0 | 0.5 | 3 | 0 | 0 |
| Water and others | balance | → | → | → | → | → |
| Felt shrinking ratio (%) | 8.8 | 8.0 | 6.2 | 6.0 | 13.0 | 9.4 |

TABLE 11-continued

| | Detergent of Invention | | | Comparative Detergent | | |
|---|---|---|---|---|---|---|
| | 1 | 2 | 3 | 1 | 2 | 3 |
| Re-contamination preventing property | o | o | o | x | x | — |

*1 2-Ethylhexyl methacrylate/diethylaminoethyl methacrylate = 95/5 (wt/wt)
*2 n-Butyl acrylate/dimethylaminoethyl acrylate = 95/5 (wt/wt)
*3 n-Butyl acrylate/methacroyloxyethylenetrimethylammonium chloride = 99/1 (wt/wt)

EXAMPLE 7

Liquid detergent of the formulations indicated in Table 12 were prepared and used to evaluate the felt shrinking property in the same manner as in Example 1 and a feel to the touch and a rinsing property at the time of washing by the following procedures. The results are shown in Table 12.

(1) Evaluation of a feel to the touch at the time of washing:

Ten panelers conducted a feeling test with respect to sliminess on the hands at the time of washing in which 5 liters of city water of 30° C. was placed in a 10 liter washtub, to which each 100 g of non-processed wool cloth pieces and acrylic fiber jerseies with a total of 200 g and 12.5 ml of a detergent.

[Evaluation Point]

2: Very slimy

1: Fairly slimy

0: Rarely slimy

The evaluation was indicated as an average of all the points of the ten panelers.

(2) Evaluation of rinsing property:

Washing was carried out for 5 minutes in the same manner as in (1), the clothings were dehydrated in a dehydrator for 30 seconds, to which 5 liters of city water of 30° C. was added, followed by washing by hand press and rinsing. One minute after the washing and rinsing, an amount of foams was visually judged and evaluated.

[Evaluation point]

2: Foams spread over the whole surface of the liquid in the washtub

1: Foams spread over half the liquid surface in the washtub

0: Little foams found in the washtub

TABLE 12

| | Composition No. | | | | | |
|---|---|---|---|---|---|---|
| | 1 | 2 | 3 | 4 | 5 | 6 |
| Polyoxyethylene ($\bar{p}$ = 10) lauryl ether (HLB = 16) | 20% | 20 | 20 | 20 | 20 | 0 |
| Latex O 2-Ethylhexyl methacrylate/ diethylaminoethyl methacrylate = 95/5 (wt/wt) | 3 | 0 | 0 | 0 | 0 | 0 |
| Latex P n-Butyl acrylate/dimethyl-aminoethyl acrylate = 95/5 (wt/wt) | 0 | 1 | 0 | 0 | 0 | 0 |
| Latex Q n-Butyl acrylate/ methacryloyloxy-ethylene trimethyl-ammonium chloride = 99/1 (wt/wt) | 0 | 0 | 0.5 | 0 | 0 | 0 |
| Polyoxyethylene ($\bar{p}$ = 100) stearyl ether (HLB = 49) | 1.5 | 0.5 | 0.5 | 1 | 0 | 0 |
| Water and other ingredients | balance | → | → | → | → | → |
| Felt shrinking ratio (area, %) | 8.8 | 6.2 | 6.0 | 12.9 | 13.0 | 9.4 |
| Feel to the touch (average value) | 0.3 | 0.2 | 0.3 | 0.7 | 1.2 | — |
| Rinsing property | 0 | 0 | 0 | 1 | 1 | — |

What is claimed is:

1. A liquid detergent composition for clothing articles comprising the following ingredients (A)′, (B-1) and (B-2):

(A)′ 0.01 to 5 wt. % of a polymer in the form of a polymer latex having a cationic group or a tertiary amino group and having an average particle size (average in weight) of from 0.005 to 0.2 micrometers with a content of the polymer whose size is in the range of from 0.005 to 0.2 micrometers being not less than 95 wt. % of the total of the polymer latex;

(B-1) 10 to 50 wt. % of a nonionic surface active agent; and (B-2) 0.01 to 10 wt. % of an anionic surface active agent.

2. A liquid detergent composition for clothing articles comprising the following ingredients (A)′, (B-1)′ and (B-1)″:

(A)′ 0.01 to 5 wt. % of a polymer in the form of a polymer latex having a cationic group or a tertiary amino group and having an average particle size (average in weight) of from 0.005 to 0.2 micrometers with a content of the polymer whose size is in the range of from 0.005 to 0.2 micrometers being not less than 95 wt % of the total of the polymer latex;

(B-1)′ 0.01 to 5 wt. % of a polyoxyalkylene nonionic surface active agent having an HLB value not less than 20; and (B-1)″ 10 to 50 wt. % of a nonionic surface active agent other than the agent of (B-1)′.

3. A liquid detergent composition for clothing articles comprising the following ingredients (A), (B-1)‴ and (C):

(A) 0.01 to 5 wt. % of a polymer in the form of a polymer latex having an average particle size (average in weight) of from 0.005 to 0.2 micrometers being not less than 95 wt% of the total of the polymer latex;

(B-1)‴ 10 to 50 wt. % of a nonionic surface active agent of the general formula $$R—O—(CH_2CH_2O)_n—H$$

in which R represents an alkyl or alkenyl group having from 10 to 20 carbon atoms, or an alkylphenyl group whose alkyl moiety has from 6 to 12 carbon atoms, and n is a value of from 1 to 20; and (C) from 0.005 to 0.2 wt. % of a hydroxycarboxylate having from 2 to 6 carbon atoms.

4. A liquid detergent composition for clothing articles comprising the following ingredients (A)″, (B) and (D):

(A)″ 0.01 to 10 wt. % of a polymer in the form of a polymer latex having a cationic group or a tertiary amino group and having a content of a remaining monomer of not larger than 100 ppm and having an average particle size (average in weight) of from 0.005 to 0.2 micrometers with a content of the polymer whose size is in the range of from 0.005 to 0.2 micrometers being not less than 95 wt % of the total of the polymer latex;

(B) 10 to 50 wt % of a surface active agent; and (D) 1 to 10 wt % of a solubilizing agent.

* * * * *